US010081015B2

(12) United States Patent
Azpiroz et al.

(10) Patent No.: US 10,081,015 B2
(45) Date of Patent: Sep. 25, 2018

(54) TRAPPING AT LEAST ONE MICROPARTICLE

(71) Applicant: International Business Machines Corporation, Armonk, NY (US)

(72) Inventors: Jaione Tirapu Azpiroz, Rio de Janeiro (BR); Emmanuel Delamarche, Thalwil (CH); Claudius Feger, Poughkeepsie, NY (US); Yuksel Temiz, Lüssiweg (CH)

(73) Assignee: International Business Machines Corporation, Armonk, NY (US)

( * ) Notice: Subject to any disclaimer, the term of this patent is extended or adjusted under 35 U.S.C. 154(b) by 259 days.

(21) Appl. No.: 14/797,170

(22) Filed: Jul. 12, 2015

(65) Prior Publication Data

US 2017/0007996 A1 Jan. 12, 2017

(51) Int. Cl.

| | |
|---|---|
| ***B01L 3/00*** | (2006.01) |
| ***B03C 5/00*** | (2006.01) |
| ***B03C 5/02*** | (2006.01) |

(52) U.S. Cl.

CPC ..... *B01L 3/502761* (2013.01); *B03C 5/005* (2013.01); *B03C 5/026* (2013.01); *B01L 2200/0668* (2013.01); *B01L 2200/0684* (2013.01); *B01L 2300/0883* (2013.01); *B01L 2400/0424* (2013.01); *B03C 2201/18* (2013.01); *B03C 2201/26* (2013.01)

(58) Field of Classification Search

CPC ..... B01L 2200/0668; B01L 2200/0684; B01L 2300/0883; B01L 2400/0424; B01L 3/502761; B03C 5/005; B03C 5/026

USPC ..... 435/29, 5, 287.1; 506/7, 33, 30, 10

See application file for complete search history.

(56) References Cited

U.S. PATENT DOCUMENTS

| | | | | |
|---|---|---|---|---|
| 7,988,841 | B2 | 8/2011 | Scurati et al. | |
| 2001/0047941 | A1* | 12/2001 | Washizu | B03C 5/026 204/547 |
| 2003/0006140 | A1* | 1/2003 | Vacca | G02B 26/005 204/547 |
| 2004/0211669 | A1* | 10/2004 | Cummings | B03C 5/026 204/547 |
| 2004/0262210 | A1* | 12/2004 | Westervelt | B01L 3/502761 210/222 |

(Continued)

OTHER PUBLICATIONS

Drag Coefficient (Nakayama, Y. Boucher, R.F.. (2000). Introduction to Fluid Mechanics (Butterworth-Heineman Edition)—9.3.3 The Drag of Sphere, p. 156. Elsevier. http://app.knovel.com/hotlink/pdf/id:kt003VLGU1/introduction-fluid-mechanics/the-drag-of-a-body). *

(Continued)

*Primary Examiner* — Maris R Kessel
*Assistant Examiner* — Joshua L Allen
(74) *Attorney, Agent, or Firm* — Daniel P. Morris; Otterstedt, Ellenbogen & Kammer, LLP

(57) ABSTRACT

A device for trapping at least one microparticle in a fluid flow is suggested. The device comprises a trapping element and an electrode. The trapping element is configured for trapping the at least one microparticle and has at least one recess for receiving the at least one microparticle. The electrode is configured for generating an asymmetric electric field. In operation, at least one microparticle of a plurality of microparticles passing through the asymmetric electric field is forced into the at least one recess of the trapping element.

11 Claims, 7 Drawing Sheets

(56) References Cited

U.S. PATENT DOCUMENTS

| | | | | |
|---|---|---|---|---|
| 2005/0123930 | A1 | 6/2005 | Lean et al. | |
| 2006/0128006 | A1* | 6/2006 | Gerhardt | B01L 3/502761 435/287.1 |
| 2009/0092989 | A1 | 4/2009 | Chang et al. | |
| 2009/0148937 | A1 | 6/2009 | Schnelle et al. | |
| 2010/0003666 | A1* | 1/2010 | Lee | B01L 3/502761 435/5 |
| 2010/0012496 | A1* | 1/2010 | Tsunazawa | B03C 5/005 204/547 |
| 2011/0045994 | A1* | 2/2011 | Voldman | B01L 3/502761 506/7 |
| 2011/0226624 | A1* | 9/2011 | Dorrer | B03C 5/005 204/547 |
| 2012/0325749 | A1* | 12/2012 | Kim | B01L 3/502753 210/660 |
| 2016/0367988 | A1* | 12/2016 | Azpiroz | B03C 5/005 |

OTHER PUBLICATIONS

Khashayar Khoshmanesh, Dielectrophoretic Platforms for Bio-microfluidic Systems. Biosensors and Bioelectronics, vol. 26, Issue 5, Jan. 15, 2011, pp. 1800-1814, provided as pp. 1-28 downloaded from http://www.deakin.edu.au/research/cisr/docs/20111800.pdf on Jun. 23, 2015.

Yuksel Temiz,Capillary-driven microfluidic chips with evaporation-induced flow control and dielectrophoretic microbead trapping. Microfluidics, BioMEMS, and Medical Microsystems XII, edited by Bonnie L. Gray, Holger Becker, Proc. of SPIE vol. 8976, 89760Y Downloaded From: http://proceedings.spiedigitallibrary.org/ on Mar. 19, 2014, pp. 1-10.

Hai-Hang Cui,Separation of particles by pulsed dielectrophoresis. Lab Chip, 2009, 9, The Royal Society of Chemistry 2009. pp. 2306-2312.

Lisen Wang,Dielectrophoresis switching with vertical sidewall electrodes for microfluidic flow cytometry. Lab Chip, 2007, 7, The Royal Society of Chemistry 2007. pp. 1114-1120.

Keith J. Morton,Hydrodynamic metamaterials: Microfabricated arrays to steer, refract, and focus streams of biomaterials. PNAS, May 27, 2008 , vol. 105 , No. 21. pp. 7434-7438.

David J. Collins,Particle separation using virtual deterministic lateral displacement (vDLD). Lab Chip, The Royal Society of Chemistry 2014 014, 14, pp. 1595-1603, Published on Feb. 28, 2014.

Dino Di Carlo, et al., Dynamic single cell culture array, Lab Chip 2006, 6, pp. 1445-1449, The Royal Society of Chemistry 2006, First published as an Advance Article on the web Sep. 4, 2006.

Ryan D. Sochol, et al., Hydrodynamic resettability for a microfluidic particulate-based arraying system, Lab Chip, The Royal Society of Chemistry 2012, 12, pp. 5051-5056, Published on Sep. 17, 2012.

Jaione Tirapu Azpiroz et al., unpublished U.S. Appl. 14/797,168, filed Jul. 12, 2015, pp. 1-42.

List of IBM Patents or Patent Applications Treated as Related.

* cited by examiner

TRAPPING AT LEAST ONE MICROPARTICLE

BACKGROUND

The invention relates to a device and a method for trapping at least one microparticle in a fluid flow and an apparatus for arranging a plurality of microparticles in a fluid flow.

Biological assays, chemical tests, chemical synthesis, processing of samples or biological fluids may require processing microparticles. For example, processing microparticles carrying different analytes on their surface may allow for surface-based assays for detecting different types of analytes including (but not limited to) DNA sequences, antigens, lipids, proteins, peptides, hydrocarbons, toxins, chemical compounds or cells. Analysis on microparticles carrying analytes may be performed, for example, by optical or electrochemical monitoring, applying fluorescence, magnetism-based sensing, fluorescence quenching. Typically, microparticles suspended in fluids are trapped using optical tweezers, magnetism, dielectrophoresis, or mechanical traps. For example, mechanical traps integrated in microfluidic chips can be used for trapping single microparticles.

Dielectrophoresis relates to the motion of polarizable particles in a non-uniform or asymmetric electric field. In particular, microparticles subjected to an electric field become polarized and make up dipoles aligned to the applied field. In a non-uniform electric field, each half of the dipole experiences unequal Coulomb forces, and a net force is exerted on the microparticle. Depending on dielectric properties including structural, morphological and chemical characteristics, the microparticles respond differently to the applied asymmetric electric field.

SUMMARY

According to a first aspect, the invention can be embodied as a device for trapping at least one microparticle in a fluid flow. The device comprises a trapping element and an electrode. The trapping element is configured for trapping the at least one microparticle and has at least one recess for receiving the at least one microparticle. The electrode is configured for generating an asymmetric electric field. In operation, at least one microparticle of a plurality of microparticles passing through the asymmetric electric field is forced into the at least one recess of the trapping element.

According to a second aspect, the invention can be embodied as an apparatus for arranging a plurality of microparticles in a fluid flow. The apparatus comprises a fluid channel and a plurality of aforementioned devices arranged in the fluid channel.

According to a third aspect, the invention can be embodied as a method for trapping a microparticle. The method comprises forcing at least one microparticle of a plurality of microparticles into at least one recess of a trapping element by generating an asymmetric electric field.

In the following, exemplary embodiments of the present invention are described with reference to the enclosed figures.

BRIEF DESCRIPTION OF THE DRAWINGS

Similar or functionally similar elements in the figures have been allocated the same reference signs if not otherwise indicated.

DETAILED DESCRIPTION

Figure 1:
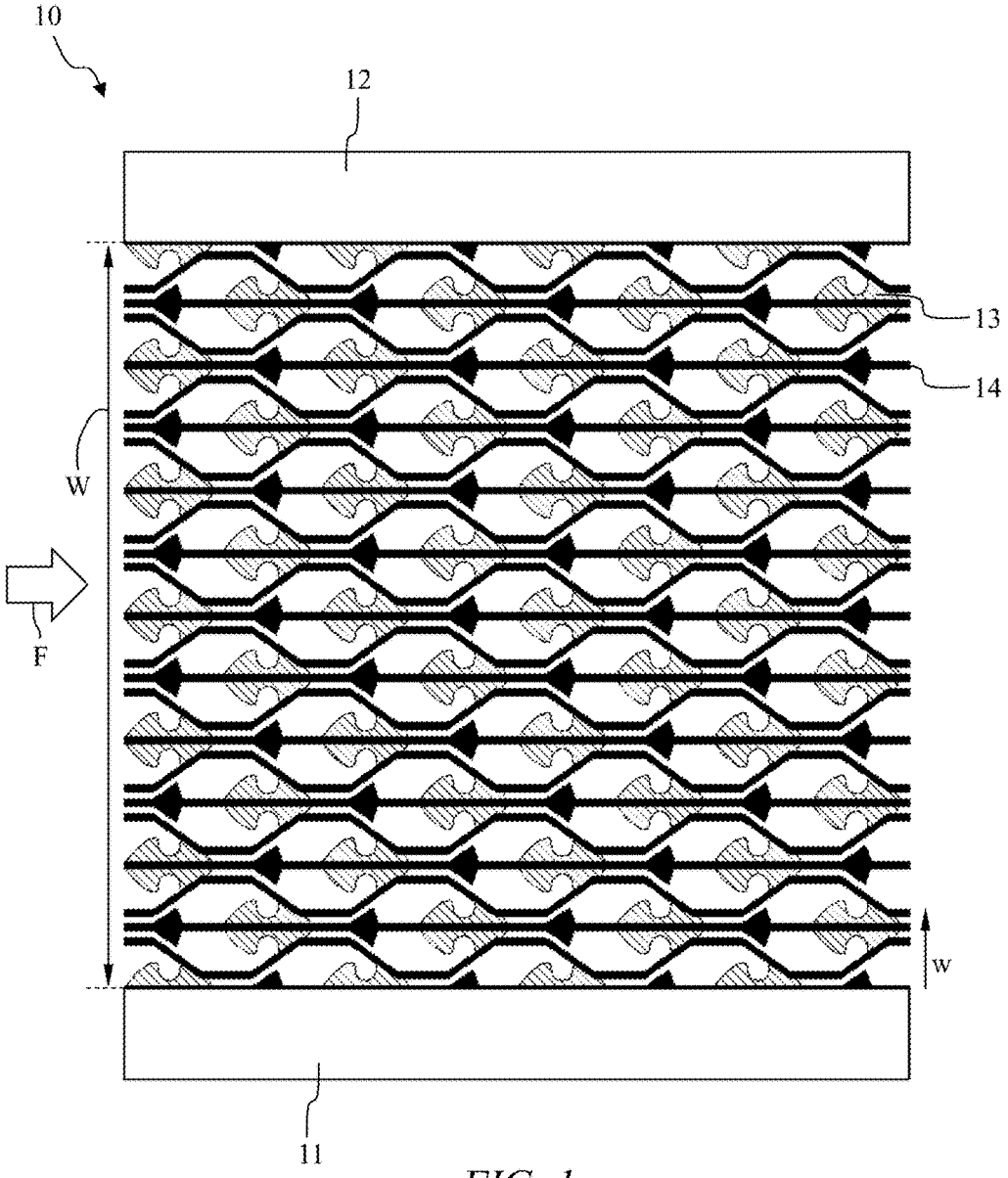
FIG. 1 shows a schematic view of an embodiment of an apparatus.

FIG. 1 shows a schematic view of an embodiment of an apparatus 10.

The apparatus 10 comprises a first wall 11 and a second wall 12. For example, the apparatus 10 is implemented in a fluid channel, and the first and second walls 11, 12 are parts of the fluid channel. A width W refers to a distance between the walls 11, 12 measured perpendicular to a flow direction F. For example, the width W is $10^{-6}$ m-$10^{-2}$ m and preferably $10^{-5}$ m-$10^{-3}$ m. A w-direction refers to a direction parallel to the width W and directing from the first wall 11 to the second wall 12.

The apparatus 10 further comprises a plurality of trapping elements 13 having one or more recesses for receiving at least one microparticle. The apparatus 10 further comprises a plurality of electrodes 14 configured to generate an asymmetrical electric field. A fluid carrying a plurality of microparticles M can flow between the walls 11, 12 in a flow direction F.

The fluid containing the microparticles M may consist of water from natural sources, tap water, distilled water, deionized water, biological buffers such as phosphate buffered saline (PBS) or Tris-acetate-EDTA (TAE), human serum, urine or saliva. Optionally, a surfactant, e.g. Tween® 20, may be added to the fluid for reducing an aggregation of the microparticles M.

In particular, the microparticles comprise polarizable solid particles, for example silica, latex, polystyrene, agarose or polymer, and may have a magnetic core. Preferably, the microparticles M include beads, microbeads or microspheres that are non-functionalized, or functionalized with amino groups, carboxylic acid functions, biotin, streptavidin, proteins, nucleotides, or oligonucleotides (DNA, RNA). The microparticles M may have a spherical shape with a diameter of $10^{-7}$ m-$10^{-3}$ m and preferably $10^{-6}$ m-$10^{-4}$ m. Preferably, the microparticles M comprise a receptor on a surface for capturing other particles, in particular analytes. The microparticles M may be used for capturing cells, pathogens, drugs, antibodies, and compounds related to cellular responses or other biological analytes for biological assays. Microparticles can also be cells, bacteria, and other microorganisms. Trapping the microparticles M using the apparatus 10 may allow for an analysis, in particular imaging, of the captured particles or the microparticles M in a defined area.

The asymmetrical electric field may force at least a part of the microparticles M into the recesses of the trapping elements 13 due to the dielectrophoresis. In particular, the microparticles M may show a negative dielectrophoretic response to the asymmetric electric field and therefore move toward a position of weaker electric field intensity, i.e. oppositely to a field intensity gradient. Accordingly, the electrodes 14 may be shaped and arranged such that the electric field intensity decreases toward the recesses of the trapping elements 13.

Figure 2:
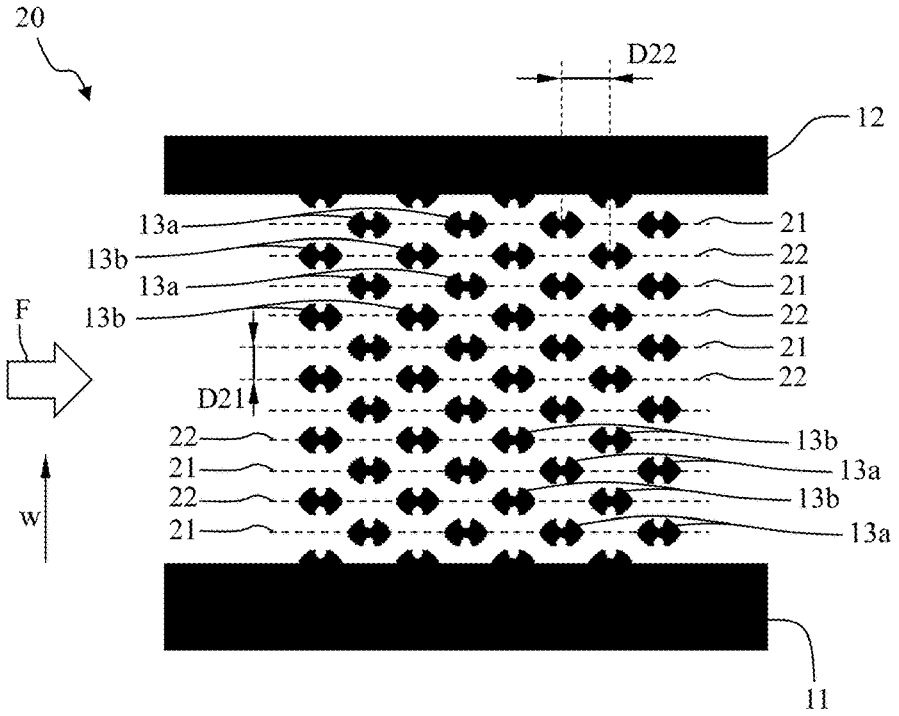
FIG. 2 shows a schematic view of an arrangement of trapping elements of the apparatus in FIG. 1.

FIG. 2 shows a schematic view of an arrangement 20 of trapping elements 13 of the apparatus 10 in FIG. 1.

For example, the plurality of trapping elements 13 is arranged in a plurality of rows 21, 22. Preferably, the rows are arranged parallel to one another and parallel to the flow direction F. An equal number of trapping elements 13 may be arranged in each of the rows 21, 22. The number of trapping elements 13 in a single row may vary between 2 and 100, for example four, as shown in FIG. 2. Trapping elements 13 which are arranged at outermost positions with respect to the w-direction can be attached to the walls 11, 12.

First rows 21 and second rows 22 may be alternatingly arranged, i.e. each of the first rows 21 may be positioned between two of the second rows 22 and vice versa, except for the outermost rows 21, 22 with respect to the w-direction. A distance D21 between two neighboring rows 21, 22 may be constant. Preferably, a distance D21 between two neighboring rows 21, 22 is $10^{-6}$ m-$10^{-3}$ m and preferably $10^{-5}$ m-$10^{-4}$ m. A distance D22 between two neighboring columns may be $10^{-6}$ m-$10^{-3}$ m and preferably $10^{-5}$ m-$10^{-4}$ m.

The plurality of trapping elements 13 may be divided into two groups of trapping elements 13*a*, 13*b*. First trapping elements 13*a* may be arranged in the first rows 21 and second trapping elements 13*b* may be arranged in the second rows. The trapping elements 13*a*, 13*b* may be equally spaced from one another and arranged in columns perpendicular to the flow direction F. In particular, the trapping elements 13*a* may be shifted in the flow direction F with respect to trapping elements 13*b*, as shown in FIG. 2.

Variations of the number of trapping elements arranged in a single row, the number of rows between the walls 11, 12 or the distance between two neighboring rows, are possible. Further, more than two different arrangements of trapping elements 13 in a single row may be alternatingly arranged.

Figure 3:
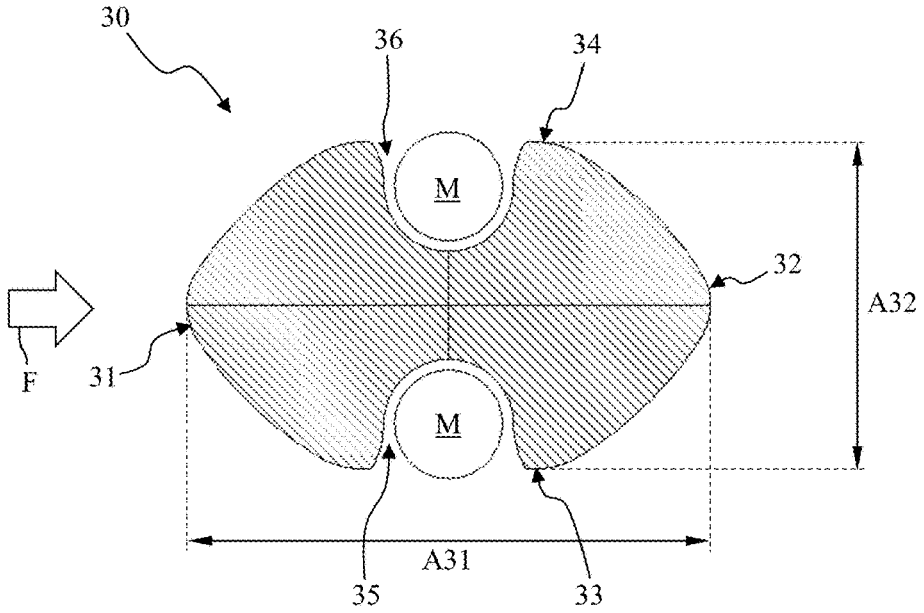
FIG. 3 shows a schematic top view of an embodiment of a trapping element with trapped microparticles.

FIG. 3 shows a schematic top view of an embodiment of a trapping element 30 including trapped microparticles M.

The trapping element 30 can comprise a front face 31 and a rear face 32. In particular, the front face 31 refers to a portion of the trapping element 30 directing in an upstream direction of the fluid flow, i.e. oppositely to the flow direction F. The rear face 32 may refer to a portion of the trapping element 30 directing in a downstream direction of the fluid flow, i.e. in the flow direction F. Further, the trapping element 30 may comprise two side faces 33, 34 which connect the front face 31 and the rear face 32 to each other.

A first recess 35 may be formed in a first side face 33, and a second recess 36 may be formed in a second side face 34. Preferably, the recesses 35, 36 are at least partially shaped according to a shape of the microparticles M. In FIG. 3, the recesses 35, 36 are circularly shaped in an inner part for receiving one of the spherical microparticles M. When recesses 35, 36 are occupied by a microparticle M, the resulting outer contour of the trapping element 30 including the microparticle M may be configured to avoid forming an obstacle or a notch for the incoming microparticles so that the incoming microparticles are not mechanically trapped and clog the channel. Also the risk of trapping multiple microparticles in the same recess is minimized.

In particular, the front face 31 can be convex, i.e. has an outward curvature. Preferably, the front face 31 is formed in a shape having a drag coefficient of 0.5 or less. For example, the front face 31 is shaped as a cone, a front of a streamlined body or a half-sphere. Preferably, the front face 31 diverts the fluid, thus the microparticles, in particular in a laminar flow, from the recess.

The rear face 32 may have a convex shape as well. Further, the rear face 32 may be shaped symmetrically to the front shape 31 with respect to an axis perpendicular to the flow direction F, thereby facilitating a manufacture of the trapping element 30. In a preferred embodiment, the trapping element 30 may be cello-like shaped. In the case of capillary-driven flow, for example, this geometry does not challenge the advancing of the liquid front and it prevents trapping air.

The embodiment of the trapping element 30 shown in FIG. 3 may have a longitudinal extension A31 in the flow direction F of $10^{-6}$ m-$10^{-3}$ m and preferably $10^{-5}$ m-$10^{-4}$ m. A lateral extension A32 perpendicular to the flow direction F may be $10^{-6}$ m-$10^{-3}$ m and preferably $10^{-5}$ m-$10^{-4}$ m. Within the extensions A31, A32, the trapping element 30 may be configured to receive one or two of the microparticles M with a diameter of $10^{-6}$ m-$10^{-3}$ m and preferably $10^{-5}$ m-$10^{-4}$ m. It is understood that the extensions A31, A32 as well as a size of the recesses 35, 36 need to be adapted to a size of microparticles for trapping the microparticles using the trapping element 30.

The trapping element 30 may correspond to at least one of the trapping element 13 of the apparatus 10. In other words, one or more trapping elements 13 may be embodied as the trapping element 30. A height, i.e. a spatial extension perpendicular to both the flow direction F and the w-direction, may be adapted to a height of a fluid channel or the apparatus 10. In particular, the height of the trapping element 30 can be $10^{-6}$ m-$10^{-3}$ m and preferably $10^{-5}$ m-$10^{-4}$ m.

Figure 4:
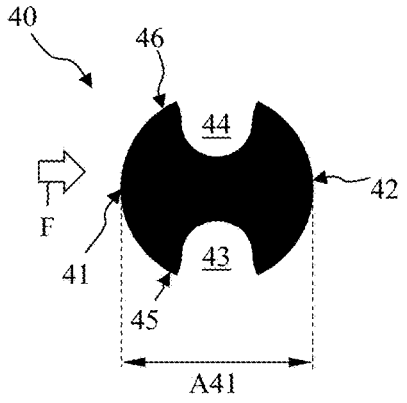
FIG. 4 shows a schematic top view of a further embodiment of a trapping element.

FIG. 4 shows a schematic top view of a further embodiment of a trapping element 40.

The trapping element 40 may have a circular shape having a front face 41 and a rear face 42 being symmetrical. Recesses 43, 44 may be formed at side surfaces 45, 46, respectively, which connect the front face 41 and the rear face 42 to each other. The recesses 43, 44 may be circular shaped for receiving one of the spherically shaped microparticles M.

The trapping element 40 may correspond to at least one of the trapping element 13 of the apparatus 10. In other words, one or more trapping elements 13 may be embodied as the trapping element 40. A spatial extension A41 of the trapping element 40 may be $10^{-6}$ m-$10^{-3}$ m and preferably $10^{-5}$ m-$10^{-4}$ m in both the flow direction F and the w-direction.

Figure 5:
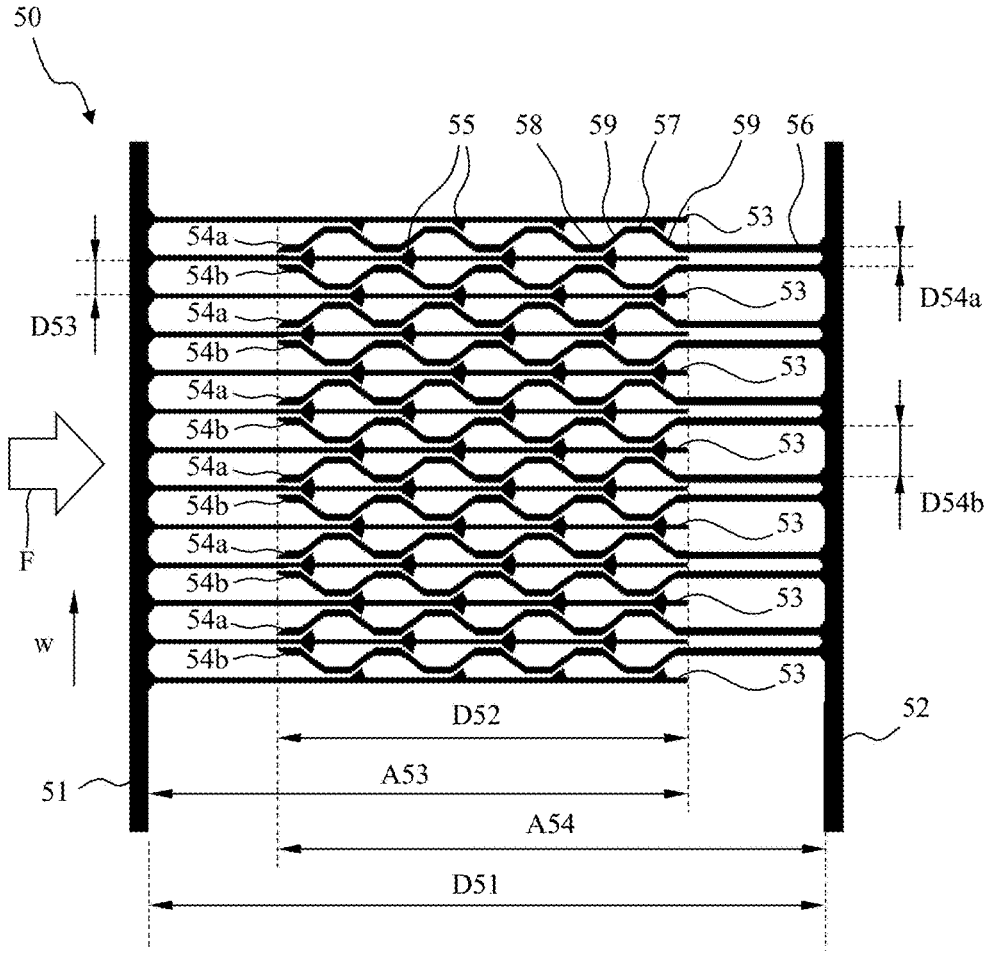
FIG. 5 shows a schematic view of an arrangement of electrodes of the apparatus in FIG. 1.

FIG. 5 shows a schematic view of an arrangement 50 of electrodes 14 of the apparatus 10 in FIG. 1.

A first power line 51 and a second power line 52 may be arranged parallel to each other at a distance of D51. For example, the power lines 51, 52 are linearly or bar-like shaped and extend perpendicular to the flow direction F. The distance D51 may be $10^{-6}$ m-$10^{-2}$ m and preferably $10^{-5}$ m-$10^{-3}$ m. The power lines 51, 52 may be connected to an electrical contact or powered by a power supply.

A plurality of first electrodes 53 extends from the first power line 51 toward the second power line 52. In particular, the first electrodes 53 extend parallel to the flow direction F. For example, the first electrodes 53 are linearly shaped or at least partially formed as wires. Preferably, the first electrodes 53 are arranged parallel to one another at a distance D53 between two neighboring first electrodes 53. The first electrodes 53 may have a length A53 from the first power line 51. The length A53 may be $10^{-6}$ m-$10^{-2}$ m and preferably $10^{-5}$ m-$10^{-3}$ m. The distance D53 may be $10^{-6}$ m-$10^{-4}$ m. In particular, the length A53 can be smaller than the distance D51, i.e. the first electrodes 53 may not reach the second power line 52. This prevents creating a strong electric field between electrodes 53 and power line 52, or electrodes 54 and power line 51, which may adversely affect the flow of microparticles. Preferably, the first electrodes 53 are positioned so as to match the rows 21, 22 of the trapping elements 13*a*, 13*b* shown in FIG. 2.

The first electrodes 53 may comprise a plurality of deflection elements 55. In particular, the deflection elements 55 may be electrically conductive. Preferably, the deflection elements 55 are uniformly shaped. For example, the deflection elements 55 has a triangle-shape and are formed on both sides of the respective first electrode 53 with respect to the w-direction. For example, the first electrode 53 may comprise an equal number of deflection elements 55, for example four. Preferably, the deflection elements 55 of two neighboring first electrodes 53 are differently positioned with respect to the flow direction F.

For example, the deflection elements 55 of each first electrode 53 are arranged at shifted positions in terms of the flow direction F with respect to the deflection elements 55 of the neighboring first electrodes 53. In particular, a distance between two neighboring deflection elements 55 in a single first electrode 53 may be constant and preferably equal the distance D22 between the trapping elements 13*a*, 13*b* in a single row 21, 22. Accordingly, the deflection elements 55 may be arranged in columns perpendicular to the flow direction F. Preferably, the columns match those formed by the trapping elements 13*a*, 13*b* shown in FIG. 2. Further, the deflection elements 55 of different first electrodes 53 may be arranged with an alternating distance from the first power line 51. Preferably, the deflection elements 55 may be arranged so as to be positioned between two neighboring trapping elements 13*a*, 13*b* in terms of both the flow direction F and the w-direction, as shown in FIG. 1.

A plurality of second electrodes 54 extends from the second power line 52 toward the first power line 51. Preferably, each second electrode 54 is arranged between two neighboring first electrodes 53, and as a result, each first electrode 53 (except for the outermost electrodes 53 with respect to the w-direction) is arranged between two neighboring second electrodes 54.

For example, the second electrodes 54 are divided into upper electrodes 54*a* and lower electrodes 54*b* that may be arranged alternatingly. Accordingly, each of the first electrodes 53 (except for the outermost electrodes 53 with respect to the w-direction) may be arranged between an upper electrode 54*a* and a lower electrode 54*b*. An upper electrode 54*a* may comprise a first portion 56 extending from the second power line 52. In particular, the first portion 56 may be arranged parallel to the flow direction F. The upper electrode 54*a* can further comprise a second portion 57 and a third portion 58 which are both arranged parallel to the flow direction F. The second portion 57 may be shifted toward the second wall 12 with respect to the third portion 58, which can be in line particularly with the first portion 56. Inclined portions 59 may connect between the second portions 57, the first portion 56 or third portions 58. In particular, the second portion 57 and the third portion 58 may have an equal length.

The lower electrodes 54*b* may be shaped symmetrically to the upper electrodes 54*a* with respect to the first electrode 53 in between. In particular, a distance between two neighboring second electrodes may alternate between two different distances D54*a*, D54*b*. Preferably, the distances D54*a*, D54*b* may sum up to twice the distance D21 between two neighboring rows 21, 22 of the trapping elements 13*a*, 13*b* in FIG. 2.

Accordingly, an upper electrode 54*a* and a neighboring lower electrode 54*b* may form multiple hexagon-like shaped cells in between. A number of the second portions 57 of each of the upper and lower electrodes 54*a*, 54*b* may equal the number of the trapping elements 13*a*, 13*b* in each row 21, 22. The second, third and inclined portions 57, 58, 59 may be arranged such that the inclined portions 59 are configured to overlap at least partially with the rear face 32 of the trapping elements 13*a*, 13*b*. In total, each trapping element 13*a*, 13*b* may be located below or above one of the first electrode 53 and inside a single hexagon-like shaped cell between two neighboring second electrodes 54*a*, 54*b*. The hexagon-like shaped cell can be regarded as a device for trapping at least one microparticle.

It is understood that the upper electrodes 54*a* and lower electrodes 54*b* can sum up to the plurality of second electrodes 54. Further, the first electrodes 53 and the second electrodes 54 then can sum up to the plurality of electrodes 14.

Figure 6:
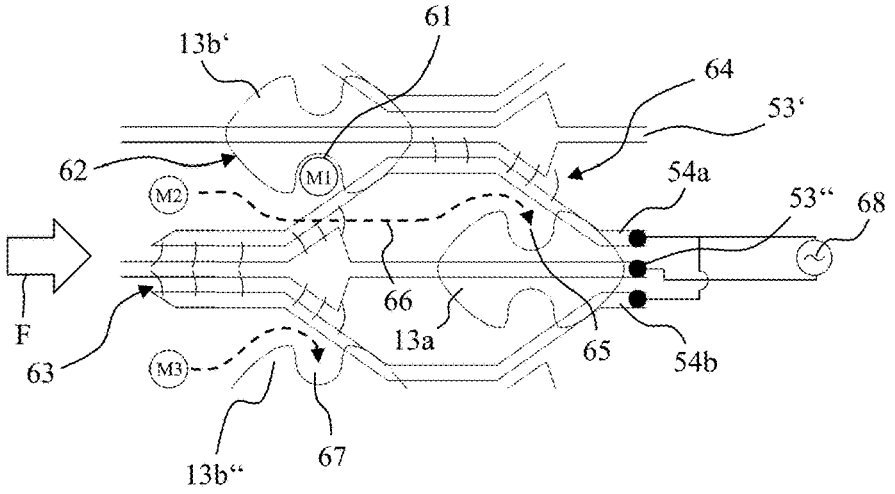
FIG. 6 shows a partial view of the apparatus illustrating trapping of the microparticles.

FIG. 6 shows a partial view of the apparatus 10 illustrating trapping of the microparticles M.

In particular, FIG. 6 shows a first microparticle M1 being captured in a recess 61 of the trapping element 13*b*'. The microparticle M2 may move in the flow direction F toward the trapping element 13*b*'. A possible trajectory of the microparticle M2 is indicated by a dashed line having an arrow 66. The microparticle M2 may impinge on a front face 62 of the trapping element 13*b'* and slide along in the fluid flow. An asymmetrical electric field 63 generated between the first electrode 53" and the second electrodes 54*a*, 54*b* may force the microparticle M2 toward the recess 61 of the trapping element 13*b'* due to the dielectrophoretic forces. In particular, the microparticle M2 may show a negative dielectrophoretic answer to the asymmetric electric field 63. Since the recess 61 is already occupied with the microparticle M1, the microparticle M2 may not be able to enter the recess 61 and move further in the flow direction F toward the trapping element 13*a*. A further asymmetrical electric field 64 may force the microparticle M2 into the recess 65 of the trapping element 13*a* due to the dielectrophoretic forces.

A further microparticle M3 may show a negative dielectrophoretic response to the asymmetric electric field 63 and be thereby forced into a recess 67 of a further trapping element 13*b*". When all the recesses 61, 67 are occupied by microparticles, new microparticles dragged by the flow F may pass all the trapping elements 13*a*, 13*b*', 13*b"* without being affected by the electric field.

Once the microparticles M1, M2 are trapped in one of the recesses 61, 65, they may be retained there as long as the respective electric fields 63, 64 are applied. For releasing the microparticles M1, M2, the electric fields 63, 64 may be turned off or adjusted, for example by tuning an applied voltage or an applied frequency.

Preferably, an electric potential or a voltage is applied between the first electrodes 53 and the second electrodes 54*a*, 54*b*. For this purpose, the electrodes 53, 54*a*, 54*b* may be connected to a voltage generator 68. The voltage generator 68 can include a power supply unit, a voltage source, an amplifier or a function generator for applying an applied voltage and an applied frequency. In particular, the applied voltage may have a sinusoidal, square or pulsed waveform. In particular, the applied voltage and the applied frequency are applied between the first power line 51 and the second power line 52. An amplitude of the applied voltage may be $10^{-1}$ V-$10^{3}$ V and preferably 1 V-$10^{2}$ V from peak to peak. The applied frequency may be $10^{4}$ Hz-$10^{7}$ Hz and preferably $10^{5}$ Hz-$3.10^{6}$ Hz.

It is understood that the trapping elements 13*a* and 13*b* differ from one another only in the position and can be interchanged in FIG. 6. It is further understood that the upper and lower electrodes 54*a*, 54*b* differ only in the position and can be interchanged in FIG. 6.

Figure 7:
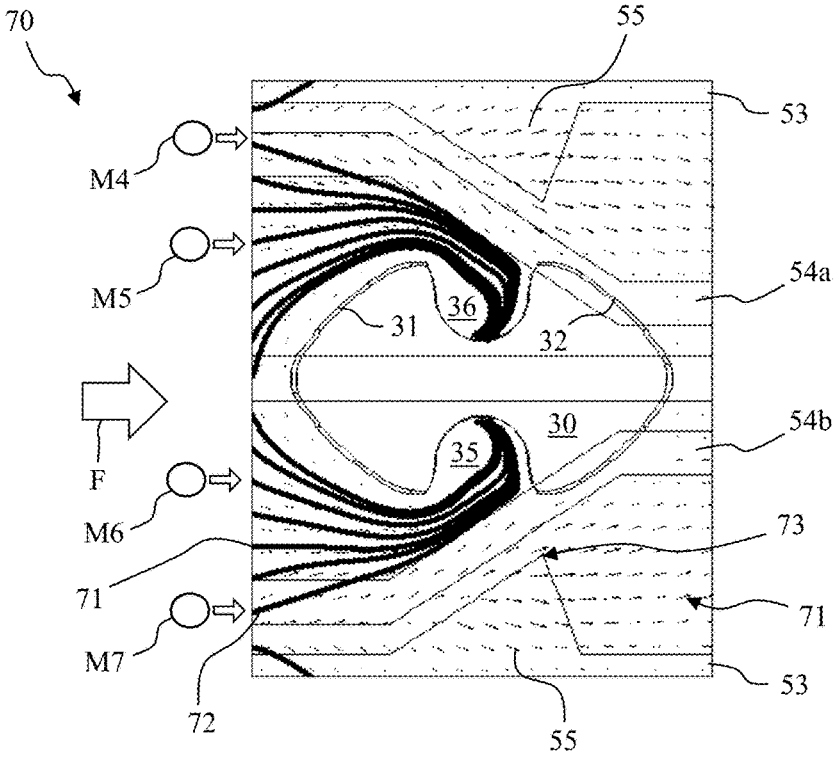
FIG. 7 shows a schematic top view of a device illustrating the force field for the microparticles.

FIG. 7 shows a schematic top view of a device 70 illustrating the force field for the microparticles M4-M7. In particular, FIG. 7 shows results from a simulation based on a finite element method (FEM).

In FIG. 7, the trapping element 13*a*, 13*b* is embodied as the trapping element 30 in FIG. 3. Arrows 71 indicate a direction and strength of the dielectrophoretic forces induced by the electrodes 53, 54*a*, 54*b*. Therefore, the arrows 71 may represent field vectors of the dielectrophoretic force field. Thick lines 72 may represent simulated possible trajectories of microparticles M4-M7 resulting from a combined effect of a hydrodynamic drag and the dielectrophoretic forces.

The hydrodynamic drag may lead the microparticles M4-M7 to move along the front face 31 of the trapping element 30, if the microparticles M4-M7 impinge on the front face 31. In particular, the device 70 may be configured to induce a negative dielectrophoretic response of the microparticles M4-M7 to the applied electric field. The dielectrophoretic force on the microparticles M4-M7 may depend on material, electrical or geometrical property of the microparticles M4-M7 and material and electrical property of the fluid carrying the microparticles M4-M7.

For example, the deflection element 55 is shaped so as to protrude toward the rear face 32 of the trapping element 30. Such a shape of the deflection element 55 may result in a field intensity decrease with an increasing distance from a tip 73 of the deflection element 55 toward the respective recess 35, 36. Accordingly, the microparticles M4, M5 may be forced into the recess 35, and the microparticles M6, M7 may be forced into the recess 36 given that the microparticles M4-M7 show a negative dielectrophoretic response.

Figure 8:
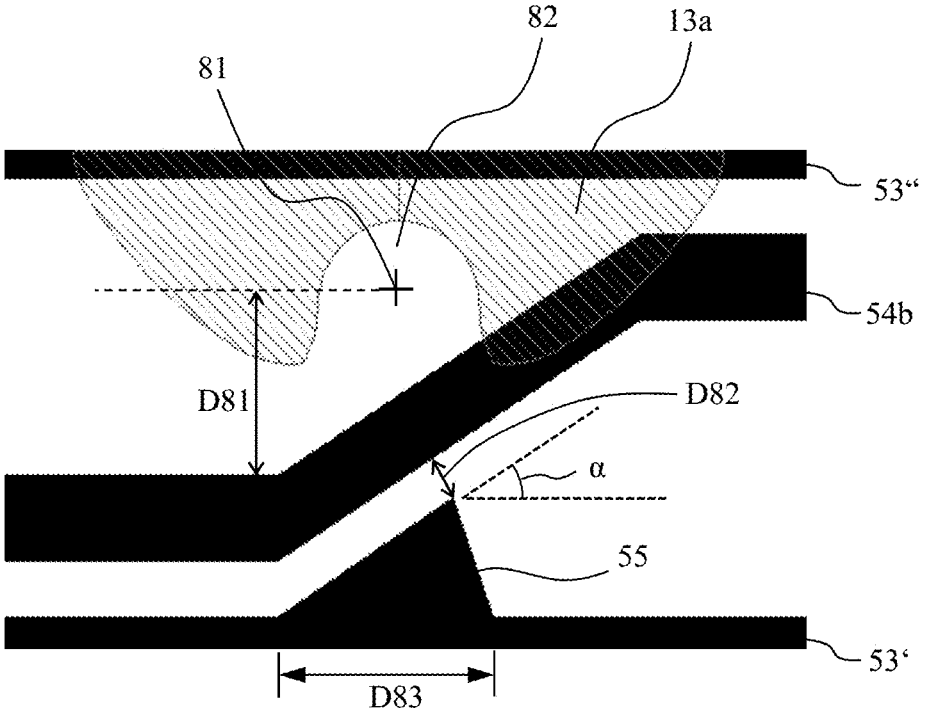
FIG. 8 shows a schematic partial view of the device in FIG. 6.

FIG. 8 shows a schematic partial view of the trapping element 13*a*, the first electrodes 53', 53" and the lower electrode 54*b* in FIG. 6.

A distance D81 between a center 81 of a recess 82 of the trapping element 13*a* from the second electrode 54*b* may be $10^{-6}$ m-$10^{-3}$ m and preferably $10^{-5}$ m-$10^{-4}$ m. A distance D82 between the deflection element 55 and the neighboring lower electrode 54*b* may be $10^{-7}$ m-$10^{-4}$ m and preferably $10^{-6}$ m-$10^{-5}$ m. The deflection element 55 may have an extension D83 of $10^{-6}$ m-$10^{-3}$ m and preferably $10^{-5}$ m-$10^{-4}$ m in the flow direction F. The deflection element 55 may protrude from the first electrode 53' at an angle $\alpha$ of 10°-80° and preferably 20°-60°.

Figure 9:
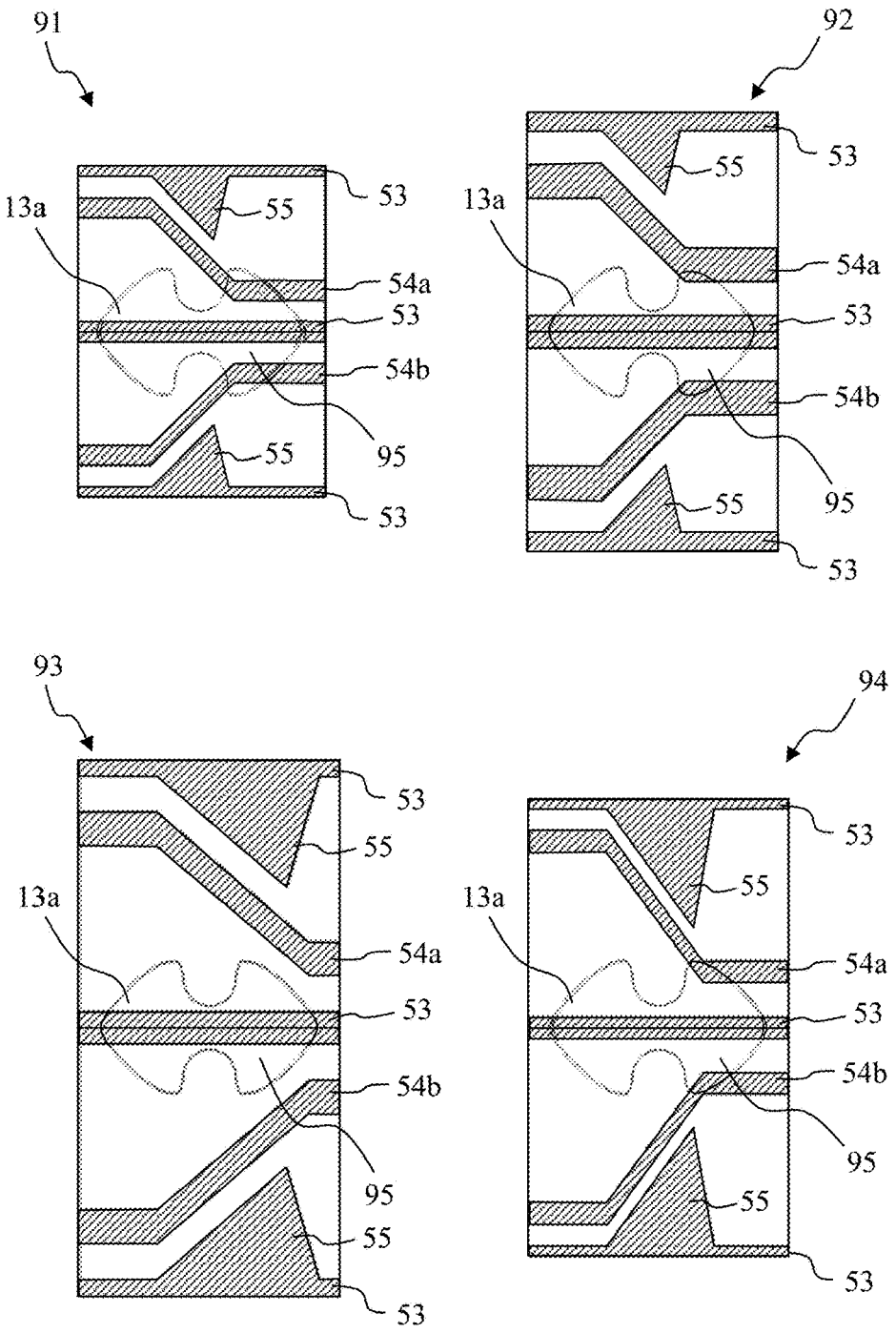
FIG. 9 shows embodiments of the device for trapping at least one microparticle.

FIG. 9 shows embodiments of a device 91-94 for trapping at least one microparticle.

The position of the trapping element 13*a* relatively to the first electrode 53 and the second electrodes 54*a*, 54*b* may be varied. A rear portion 95 of the trapping element 13*a* may partially overlap with the electrodes 53, 54*a*, 54*b* as shown in the embodiments 91, 92, 94. An overlapping area of the trapping element 13*a* with the electrodes 53, 54*a*, 54*b* may be varied. A distance between the deflection elements 55 and the trapping element 13*a* may be varied. A thickness of the electrodes 53, 54*a*, 54*b* may be varied at least in parts.

Figure 10:
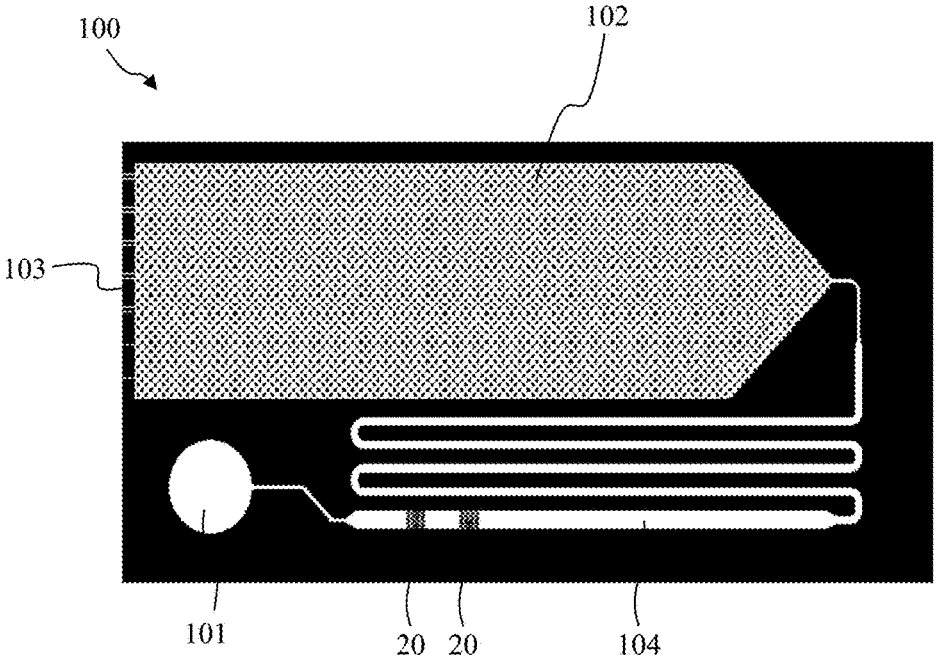
FIG. 10 shows a schematic top view of an embodiment of a microfluidic layer.

FIG. 10 shows a schematic top view of an embodiment of a microfluidic layer 100.

The microfluidic layer 100 may comprise an inlet port 101 and a capillary pump 102. The capillary pump 102 may be connected to several air vents 103. A microfluidic channel 104 may connect the inlet port 101 and the capillary pump 102 to each other. The microfluidic channel 104 may have linearly shaped portions and bending portions and taper or widen at one or multiple positions.

The inlet port 101 may be configured to be fluidly connected and introduce a fluid carrying microparticles into the microfluidic channel 104. For example, a volume of the fluid may be pipetted into the inlet port 101.

The capillary pump 102 may be configured to generate a capillary-driven fluid flow in the microfluidic channel 104 toward the capillary pump 102. The air vent 103 may be configured for limiting an air compression in the capillary pump 102. Alternatively, a microfluidic pump may be used for generating a pressure gradient in the microfludic channel 104 and thereby inducing a fluid flow.

One or multiple arrangements 20 of trapping elements 13 may be arranged inside the microfluidic channel 104 and, for example, positioned one after the other in a microfluidic channel 104 and/or in a parallel configuration in multiple microfluidic channels. The microparticles M may be fed into the microfluidic channel 104 through the inlet port 101 and move along the fluid flow in the microfluidic channel 104 toward the capillary pump 102. The microparticles M may be captured by the trapping elements 13 while passing the arrangements 20.

The microfluidic layer 100 may be implemented in a microfludic chip. A top face of the microfluidic layer 100 or the microfluidic chip may be transparent, in particular in areas corresponding the arrangements 20, thereby allowing for an imaging or analysis of captured microparticles.

The microfluidic layer 100 may be formed on a glass or silicon substrate. In particular, the substrate may be passivated, for example by forming a silicon dioxide layer. Further possible substrate materials include plastics, printed circuit board materials (e.g. glass-reinforced epoxy laminate sheets, FR-4) and PDMS. A substrate may have a thickness of $10^{-6}$ m-$10^{-2}$ m.

The microfludic layer 100 may be formed by structuring a photosensitive layer (e.g. SU-8, dry-film resist or positive photoresist) or etching a deposited film (e.g. parylene or polyimide). Alternatively, the microfluidic layer 100 may be formed by first etching the substrate and then embossing or injecting a molding, in case plastics is used for forming the microfluidic layer 100, or soft-lithography, in case elastomers are used for forming the microfluidic layer 100.

The microfluidic layer 100 may be sealed using a prepatterned adhesive film, elastomer or dry-film resist. Alternatively, the microfluidic layer 100 may be sealed by bonding two substrates, for example by an anodic bonding, adhesive bonding, thermoplastic bonding or lamination. The microfluidic layer 100 may have a height, i.e. an extension perpendicular to both the fluid direction and the w-direction, of $10^{-6}$ m-$10^{-3}$ m. A layer covering the microfluidic layer 100 may have a thickness of $10^{-6}$ m-$10^{-3}$ m.

In particular, the microparticles carried by the fluid in the microfluidic channel 104 may move with a velocity of $10^{-4}$ m/s-$10^{-2}$ m/s and preferably $5{\cdot}0^{-4}$ m/s-$5{\cdot}10^{-3}$ m/s.

Figure 11:
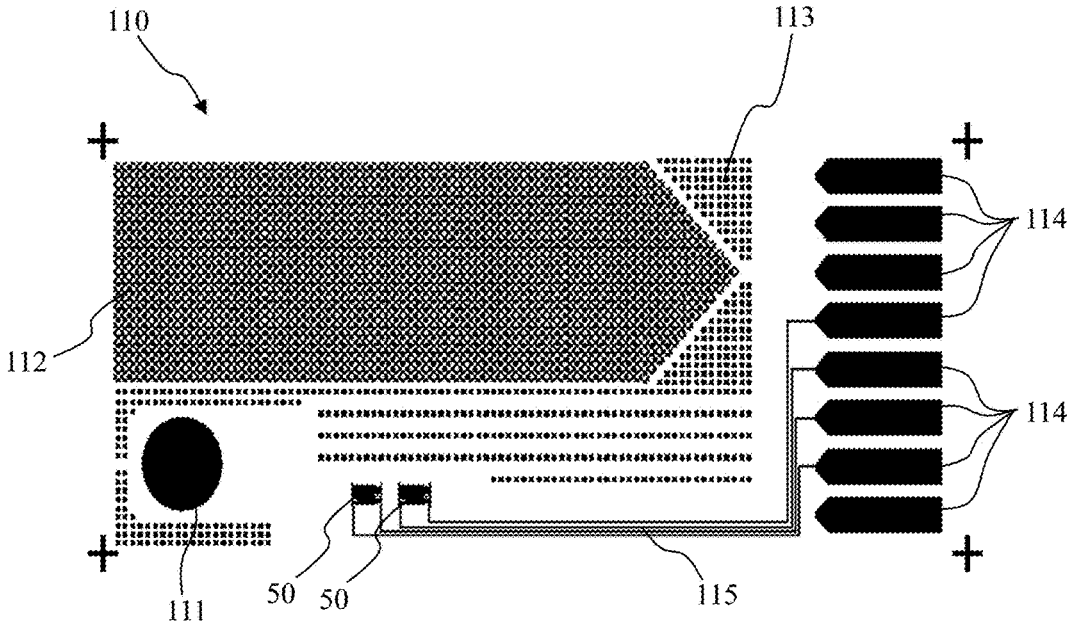
FIG. 11 shows a schematic top view of an embodiment of a metallic structure.

FIG. 11 shows a schematic top view of an embodiment of a metallic structure 110 corresponding to FIG. 10.

The metallic structure 110 may comprise a contact 111 for the inlet port 101, arrangement 112 corresponding to the capillary pump 102 and patterns 113 supporting a lift-off of the microfluidic layer 100 or the layer which covers the microfludic layer 100 or the metallic structure 110. Further, the metallic structure 110 may comprise a plurality of electrical contacts 114 and respective power lines 115.

One or more arrangements 50 of electrodes 14 may be formed at positions corresponding to the arrangements 20 of trapping elements 13. The power lines 115 may connect each of the arrangements 20 to one of the electrical contacts 114 electrically. At least one of the electrical contacts 114 may be formed as a ground contact.

The metallic structure 110, in particular the electrodes 14, may be formed by etching or using lift-off processes. For example, the metallic structure may comprise gold, platinum, palladium, titanium or aluminum. Alternatively, the metallic structure 110 may be formed on a cover layer comprising glass, silicon, dry-film resist, plastics or PDMS. Alternatively, the metallic structure 110 may be formed inside the microfluidic layer 100 and on the substrate. The metallic structure 110 or the electrodes 14 may have a height of $10^{-9}$ m-$10^{-6}$ m.

The suggested device, apparatus or method may allow for localizing microparticles, in particular beads carrying biological analytes, in specific areas. Further, a density, arrangement or spatial distribution of the microparticles trapped in the trapping elements 13 can be adjusted by adapting the configuration of the suggested device or apparatus accordingly. Microparticles of different sizes or shapes can be localized separately by shaping and arranging the trapping elements 13 accordingly.

Trapping microparticles using mechanical traps may have drawbacks such as: the particles cannot be released once they are trapped, several particles can occupy the same trap or incoming particles can clog the regions between the traps. Further, trapping microparticles using dielectrophoretic forces alone may require strong electric fields, accompanied by the risk of damaging the electrodes and generating gas due to electrolysis, in order to overcome the drag force of the fluid flow. The dielectrophoretic trapping may further require slow flow rates that may adversely affect the trapping efficiency, i.e. sedimentation of the microparticles and less number of incoming particles in a given time. In addition, trapped particles may be mobile in the trapping area so that the arrangement of the trapped particles changes as new particles arrive and are trapped. Using the suggested device, apparatus or method, microparticles can be pushed orthogonal to a fluid flow by dielectrophoresis and mechanically trapped against the drag force of the flow. As a result, a lower electric field may be required in comparison to trapping only by dielectrophoresis or mechanical traps, incoming particles may not alter the arrangement of already-trapped particles, and trapped particles can be released by adjusting or turning off the electric field.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

More generally, while the present invention has been described with reference to certain embodiments, it will be understood by those skilled in the art that various changes may be made and equivalents may be substituted without departing from the scope of the present invention. In addition, many modifications may be made to adapt a particular situation to the teachings of the present invention without departing from its scope. Therefore, it is intended that the present invention not be limited to the particular embodiments disclosed, but that the present invention will include all embodiments falling within the scope of the appended claims.

REFERENCE SIGNS

10 apparatus
11, 12 wall
13, 13*a*, 13*b* trapping element, plurality of trapping elements
14 electrode, plurality of electrodes
20 arrangement
21, 22 row
30 trapping element
31 front face
32 rear face
33, 34 side face
35, 36 recess
40 trapping element
41 front face
42 rear face
43, 44 recess
45, 46 side face
50 arrangement
51, 52 power line
53, 54, 54*a*, 54*b* electrode
55 deflection element
56-59 portion
61 recess
62 front face
63, 64 electric field
65 recess
66 trajectory
67 recess
68 power supply
70 device
71 dielectrophoretic force
72 trajectory
73 tip
81 center
82 recess
91-94 device
95 rear portion
100 microfluidic layer
101 inlet port
102 capillary pump
103 air vent
104 microfluidic channel
110 metallic structure
111 contact
112 structure
113 lifting element
114 electrical contact
115 power line A31, A32 extension
A53, A54 length
D21, D22 distance
D51-D54*b* distance
D81-D83 distance
F flow direction
M, M1-M7 microparticle, plurality of microparticles
w direction
W width
α angle

What is claimed is:

1. A device for trapping at least one microparticle in a fluid, comprising:

a trapping element for trapping the at least one microparticle, the trapping element protruding across a flow direction of the fluid and extending further along the flow direction than across the flow direction, the trapping element having a front face facing upstream against the flow direction, a rear face facing opposite the front face downstream toward the flow direction, and at least one recess formed in a side face of the trapping element, between the front face and the rear face, for receiving the at least one microparticle;

a first electrode that is offset from the trapping element across the flow direction and extends further parallel to the flow direction than across the flow direction, wherein the first electrode is generally linear with a broadened deflection element that is aligned to the at least one recess of the trapping element;

an upper second electrode that is disposed between the trapping element and the first electrode and extends further parallel to the flow direction than across the flow direction, wherein the upper second electrode includes a generally linear first portion that is offset from the trapping element and proximate to the first electrode, a generally linear second portion that overlaps the rear face of the trapping element, and a generally linear first inclined portion that connects the first portion and the second portion between the broadened deflection element of the first electrode and the at least one recess of the trapping element;

a lower second electrode that is symmetric to the upper second electrode across the trapping element; and a voltage generator connected between the first and second electrodes;

wherein the first electrode and the second electrodes are respectively shaped for generating an asymmetric electric field between the second electrodes and the first electrode when the voltage generator is energized, such that, in operation, the at least one microparticle of a plurality of microparticles passing in the fluid through the asymmetric electric field is forced into the at least one recess of the trapping element.

2. The device of claim 1, wherein the front face and the rear face of the trapping element are symmetrically shaped with respect to an axis perpendicular to the flow direction.

3. The device of claim 1, wherein the front face of the trapping element is formed in a shape having a drag coefficient of 0.5 or less.

4. The device of claim 1, wherein the trapping element extends $10^{-6}$ m to $10^{-3}$ m in directions both parallel and perpendicular to the flow direction.

5. The device of claim 1, wherein the trapping element is disposed at least partly within a hexagonal cell defined between the upper and lower second electrodes.

6. The device of claim 1, wherein at least one spatial extension of the at least one recess is in the range of $10^{-8}$ m to $10^{-3}$ m.

7. The device of claim 1, wherein the broadened deflection element has a triangular shape.

8. The device of claim 7, wherein the broadened deflection element is shaped so as to protrude from the first electrode toward the rear face of the trapping element.

9. An apparatus for trapping a plurality of microparticles in a fluid, comprising:

a microfluidic layer defining an inlet port, a capillary pump, and a fluid channel connecting the inlet port to the capillary pump, a flow direction of the fluid being in the fluid channel from the inlet port to the capillary pump;

a plurality of trapping elements arranged in staggered fashion across and along the fluid channel, each of the trapping elements having a front face facing upstream against the flow direction, a rear face facing opposite the front face downstream toward the flow direction, and at least one recess formed in a side face of the trapping element between the front face and the rear face for receiving at least one microparticle of the plurality of microparticles;

a metallic structure covering the microfluidic layer and defining a first power line at an upstream end of the apparatus and a second power line at a downstream end of the apparatus;

a voltage generator connected between the first and second power lines;

a plurality of first electrodes connected to the first power line and extending from the first power line toward the second power line parallel the flow direction; and a plurality of second electrodes connected to the second power line and extending from the second power line toward the first power line parallel the flow direction;

wherein the plurality of first electrodes include interleaved pairs of first electrodes that are symmetric across respective first trapping elements across the flow direction, each of the first electrodes extending further parallel the flow direction than across the flow direction, and being generally linear with a broadened deflection element that is aligned to the at least one recess of the respective first trapping element, each of the first electrodes being aligned along a respective second trapping element that is offset from the respective first trapping element along and across the flow direction;

the plurality of second electrodes include pairs of upper and lower second electrodes that are disposed between the respective first trapping elements and the corresponding pair of first electrodes, each of the second electrodes extending further parallel the flow direction than across the flow direction, each of the second electrodes including a generally linear first portion that is offset from the respective first trapping element and proximate to a respective one of the corresponding pair of first electrodes, a generally linear second portion that overlaps the rear face of the respective first trapping element, and a generally linear first inclined portion that connects the first portion and the second portion between the broadened deflection element of the respective one of the corresponding pair of first electrodes and the at least one recess of the respective first trapping element; and the first electrodes and the second electrodes are respectively shaped for generating an asymmetric electric field between the second electrodes and the first electrodes when the voltage generator is energized, such that, in operation, at least one microparticle of the plurality of microparticles passing through the asymmetric electric field is forced into the at least one recess of at least one of the trapping elements.

10. A method for trapping at least one microparticle in a fluid, comprising:

providing a device for trapping the at least one microparticle in the fluid, the device comprising:

a trapping element for trapping the at least one microparticle, the trapping element protruding across a flow direction of the fluid and extending further along the flow direction than across the flow direction, the trapping element having a front face facing upstream against the flow direction, a rear face facing opposite the front face downstream toward the flow direction, and at least one recess formed in a side face of the trapping element, between the front face and the rear face, for receiving the at least one microparticle;

a first electrode that is offset from the trapping element across the flow direction and extends further parallel the flow direction than across the flow direction, wherein the first electrode is generally linear with a broadened deflection element that is aligned to the at least one recess of the trapping element;

an upper second electrode that is disposed between the trapping element and the first electrode and extends further parallel the flow direction than across the flow direction, wherein the upper second electrode includes a generally linear first portion that is offset from the trapping element and proximate to the first electrode, a generally linear second portion that overlaps the rear face of the trapping element, and a generally linear first inclined portion that connects the first portion and the second portion between the broadened deflection element of the first electrode and the at least one recess of the trapping element;

a lower second electrode that is symmetric to the upper second electrode across the trapping element; and a voltage generator connected between the first and second electrodes;

wherein the first electrode and the second electrodes are respectively shaped for generating an asymmetric electric field between the second electrodes and the first electrode when the voltage generator is energized; and forcing the at least one microparticle into the at least one recess of said trapping element by energizing the voltage generator.

11. The method of claim 10, further comprising: releasing the retained microparticle by adjusting or turning off the voltage generator.

* * * * *